US010415282B2

(12) United States Patent
Klaffke et al.

(10) Patent No.: US 10,415,282 B2
(45) Date of Patent: Sep. 17, 2019

(54) RELEASABLE HINGE ARRANGEMENT WITH GUARD AGAINST FAULTY OPERATION

(71) Applicant: Solarlux GmbH, Melle (DE)

(72) Inventors: Matthias Klaffke, Belm (DE); Uwe Niehausmeier, Rödinghausen (DE)

(73) Assignee: Solarlux GmbH, Melle (DE)

( * ) Notice: Subject to any disclaimer, the term of this patent is extended or adjusted under 35 U.S.C. 154(b) by 8 days.

(21) Appl. No.: 15/866,657

(22) Filed: Jan. 10, 2018

(65) Prior Publication Data

US 2018/0202206 A1 Jul. 19, 2018

(30) Foreign Application Priority Data

Jan. 13, 2017 (DE) ..... 10 2017 100 644

(51) Int. Cl.
*E05D 7/10* (2006.01)
*E05D 3/02* (2006.01)
(Continued)

(52) U.S. Cl.
CPC ..... *E05D 3/02* (2013.01); *E05D 5/128* (2013.01); *E05D 7/1022* (2013.01); *E05D 15/26* (2013.01);
(Continued)

(58) Field of Classification Search
CPC ..... Y10T 16/53607; Y10T 16/5361; Y10T 16/557; Y10T 16/536075; Y10T 16/553; Y10T 16/5535; E05D 7/1022; E05D 7/1005; E05D 7/1027; E05D 7/1055; E05D 7/123; E05D 3/02; E05D 5/02; E05D 5/12; E05D 5/128; A47B 2220/0072
See application file for complete search history.

(56) References Cited

U.S. PATENT DOCUMENTS 516,546 A * 3/1894 McCauley ..... E05D 11/082 16/338
713,338 A * 11/1902 Paquette ..... E05D 5/128 16/381
(Continued)

FOREIGN PATENT DOCUMENTS

| | | |
|---|---|---|
| AT | 272887 | 7/1969 |
| DE | 77 32 649 | 2/1978 |
| DE | 195 21 539 | 12/1996 |

*Primary Examiner* — Chuck Y Mah
(74) *Attorney, Agent, or Firm* — Gudrun E. Huckett

(57) ABSTRACT

A hinge arrangement for detachably connecting construction elements that are to be pivotably connected to each other is provided with an axial pin with a first end provided with a collar wider than the pin body. A first hinge part with a first bushing is to be connected to a first construction component. A second hinge part with a second bushing is to be connected to a second construction component. The first and second hinge parts are connected pivotably to each other by the axial pin extending through the first and second bushings. The axial pin has a recess. The first hinge part has a fixation element extending into the first bushing and slidable transverse to a longitudinal extension of the axial pin. The fixation element has a projection projecting in a connected state of the first and second construction elements into the recess of the axial pin.

9 Claims, 7 Drawing Sheets

(51) Int. Cl.
*E05D 15/26* (2006.01)
*E05D 5/12* (2006.01)
*E05D 11/10* (2006.01)

(52) U.S. Cl.
CPC .... *E05D 7/1061* (2013.01); *E05D 2011/1092* (2013.01); *E05Y 2900/132* (2013.01); *E05Y 2900/531* (2013.01)

(56) References Cited

U.S. PATENT DOCUMENTS 1,189,201 A * 6/1916 Hurd ..... E05D 5/128 16/381
1,563,869 A * 12/1925 Gustaf ..... E05D 7/0027 16/243
1,758,309 A * 5/1930 Block ..... E05D 11/1007 16/332
3,448,486 A * 6/1969 Wright ..... E05D 11/00 16/324
3,733,649 A * 5/1973 Nagy ..... E05D 7/1016 16/380
3,852,943 A * 12/1974 Healy ..... A62B 1/14 16/257
3,969,788 A * 7/1976 McCullough ..... E05D 11/1007 16/326
4,475,266 A * 10/1984 Suska ..... E05D 5/128 16/273
5,040,268 A * 8/1991 Knurr ..... E05D 5/10 16/261
5,666,695 A * 9/1997 Jegers ..... E05D 7/1022 16/380
5,711,053 A * 1/1998 Hafner ..... E05D 5/128 16/380
5,722,121 A 3/1998 Lau et al.
8,464,396 B2 * 6/2013 Westby ..... E05D 5/12 16/380
2007/0029057 A1 2/2007 Schneider
2017/0057310 A1 * 3/2017 Smith ..... B60D 1/52
2017/0268269 A1 * 9/2017 Nicholas ..... E05D 5/06

* cited by examiner

RELEASABLE HINGE ARRANGEMENT WITH GUARD AGAINST FAULTY OPERATION

BACKGROUND OF THE INVENTION

The invention relates to a hinge arrangement for releasably connecting construction elements such as doors or windows that are to be connected to each other in a pivotable way, in particular folding panels of a folding device, wherein the hinge arrangement comprises an axial pin (hinge pin) provided with one thicker end in the form of a collar and further comprises at least two hinge parts, each to be fastened to one of the construction elements, wherein the hinge parts are pivotably connected relative to each other by the hinge pin extending through bushings embodied in the hinge parts. The invention also relates to a folding device with such a hinge arrangement.

In order to be able to clean the exterior side of folding panels of folding devices that are difficult to access, in particular when located at high-up floors of a building, from the interior of the building without a problem, so-called cleaning hinges must be employed as hinges. They are comprised in practice of a multi-part hinge with an axial pin (hinge pin or hinge bolt) provided at the top with a collar that can be gripped so that it can be pulled out by hand from the hinge bushings. It is however important in this context that the folding device for this purpose is partially opened and the panels which remain closed must be locked in the plane of the frame so that the opened panels that are to be separated from each other are secured by means of the closed panels within the folding device and cannot accidentally turn over. When the opened panels to be separated from each other however stay hinged at the closed panels, the hinge connection between two folded panels can be released by means of the hinge pin in that the hinge pin is pulled out upwardly. The panels can then be separated and folded inward so that the exterior side is accessible for cleaning from the interior of the building. Such cleaning hinges are used primarily in connection with folding elements of balconies. However, hinge pins that are pulled out completely from the hinge parts must be stored during the cleaning action of the folding device and may be lost. Hinge pins that are not completely pulled out can possibly fall out and can also be lost. On the other hand, when a hinge bolt accidentally has not been completely installed again, it is possible that the hinge bolt in the folding device that has been closed again may become loose and detached from the hinge due to further operating steps performed with the folding device so that the panel connection will separate without this being noticed. Moreover, the hinge pins not only can be removed accidentally but also can be removed intentionally in order to cause damage, e.g. for carrying out a burglary or for the purpose of vandalism.

The invention has therefore the object to provide a hinge arrangement and a folding device that exhibit increased safety in particular in regard to faulty operation.

SUMMARY OF THE INVENTION

This object is solved by a hinge arrangement wherein the hinge pin comprises a recess and at least one of the hinge parts comprises a fixation element that extends into the bushing of the hinge part and is slidable transverse to the longitudinal extension of the hinge pin, wherein the fixation element comprises a projection that is projecting, in the connected state of the construction elements, into a recess of the hinge pin.

The object is further solved in connection with the folding device in that the folding device employs such a hinge arrangement.

By providing at least one of the hinge parts of the hinge arrangement with a fixation element which is slidable transverse to the longitudinal extension of the axial pin and is extending with a projection into a complementary recess of the axial pin that is complementary when the hinge arrangement is closed, the connection between the two construction elements is secured against accidental release or detachment. Also, the axial pin cannot be driven out easily from the bushings because the fixation element secures its position.

Preferably, the fixation element is spring-loaded in the direction toward the axial pin so that during assembly it will automatically snap into place as soon as the recess of the axial pin reaches the region of the projection of the fixation element. For simplified actuation, the fixation element can be provided at its end which is facing away from the axial pin with an actuation handle, in particular in the form of a grip element or a tab, wherein the actuation handle projects past the other elements of the hinge arrangement and wherein, by means of the actuation handle, the projection of the fixation element can be pulled actively away from the recess of the axial pin against the spring force. By means of this actuation handle, the hinge arrangement can be released in a simplified way because then the axial pin, by gripping its collar, can be pulled out from at least one of the hinge parts. An accidental release is however prevented since, prior to pulling out the axial pin, an active actuation of the fixation element is required. The fixation element itself is preferably secured in the hinge part in such a way that it comprises a stop which limits its movement in a direction away from the axial pin. In this way, the fixation element cannot accidentally be pulled out completely from the hinge part.

The actuation handle is to be arranged particularly in such a way that, when the folding device is closed, it is located within an intermediate space between the connected folding panels and is thus in a region that is not accessible from the exterior. Since an actuation of the fixation element for release of the connection between the folding panels is necessary, it is nearly impossible in such an arrangement to drive the axial pin out of the bushings of the hinge parts by use of force from the exterior. Such an arrangement therefore also provides for improved protection against burglary.

In an advantageous embodiment of the hinge arrangement according to the invention, not only one of the hinge parts is provided with the afore described fixation element but a further hinge part has also a locking element which is slidable transverse to the longitudinal extension of the axial pin and is at least partially movable into the interior of the bushing of this hinge part. The locking element can be, for example, a locking ball or sphere or preferably a locking bolt. This locking element is preferably also supported by spring loading in the direction toward the axial pin. It serves for captively securing the axial pin in an open cleaning position in which the hinge parts of the hinge arrangement and thus the construction elements that are carrying them are separated from each other. Accordingly, the axial pin can be pulled out of the bushing of one hinge part but remains secured in the further hinge part in that the locking element engages in the further hinge part the recess of the axial pin and hinders the axial movement of the axial pin in both directions. Preferably, this is the recess that is engaged in the fixation state by the fixation element. The axial pin can however also comprise a further recess especially for the locking element.

Due to the configuration with a locking element, it is also made possible to mount the hinge arrangement such that the collar, which is wider than the diameter of the remaining axial pin body, is projecting downwardly from the lower bushing but the axial pin still cannot fall out when the hinge parts are released. In practice, this is a handling and safety advantage because the axial pin, in case of hinge arrangements that are mounted at a high position, can be pulled out downwardly so that in most cases no ladder is required anymore.

For avoiding faulty operation, fixation element, recess(es) of the axial pin, and position of the locking element should be arranged relative to each other within the hinge arrangement such that, when the hinge is released by the axial pin being partially pulled out and the locking element engaging its recess, the end of the axial pin facing away from the collar does not project from the bushing of the hinge part that is provided with the locking element. In this way, jamming and canting are avoided when assembling the hinge arrangement again.

A further safety feature against possible faulty operation can be preferably achieved in that the axial pin has a marking which can be seen in the pulled-out state but is not visible in the connected state in which the axial pin is completely pushed into the hinge parts. Such a marking can be, for example, designed as a visible warning marking in that the part that adjoins the collar of the axial pin, which part in the closed hinge arrangement is located inside the bushing, is provided with a warning color (signal color). As an alternative or a supplement, it is also conceivable to provide markings that can be sensed by touching such as grooves or depressions. Also, such a marking can be provided on the fixation element so that it cannot be recognized when the projection is extending into the recess of the axial pin but is recognizable when the fixation element is pulled out.

When the hinge arrangement is to be assembled again, for example, after cleaning the outer surfaces of the temporarily separated folding panels, the axial pin can be pushed again into all bushings of the hinge after congruently aligning the hinge parts. This is facilitated when the recess of the axial pin in the direction toward the collar is provided with an insertion ramp, for example, an elongate bevel, that pushes back the locking element automatically. The locking element therefore must have no external actuation possibility but reaches the respective predetermined position solely by its support and pretension.

Further advantages and details result from the dependent claims and the embodiment illustrated in the Figures which will be explained in the following.

DESCRIPTION OF THE PREFERRED EMBODIMENTS

The folding device illustrated in FIG. 1 comprises a total of five panels of which the outermost panel to the left in the illustration is a rotary panel that can be opened and the adjoining panels 1, 2 are folding panels that are connected to their neighboring panels on both sides of the folding panels. The positions P between the folding panels 1, 2 that are marked by circles are possible installation locations of the hinge arrangement according to the invention.

Figure 1A:
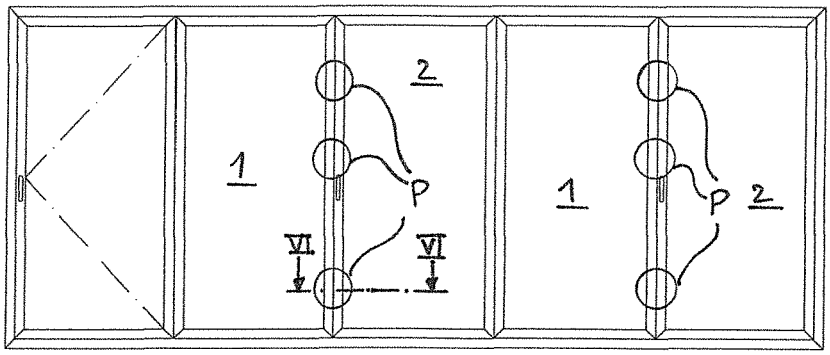
FIGS. 1*a*, 1*b*, 1*c* show a folding device in closed position (FIG. 1*a*), partially open position (FIG. 1*b*), and with panels to be cleaned separated from each other (FIG. 1*c*).
Figure 1B:
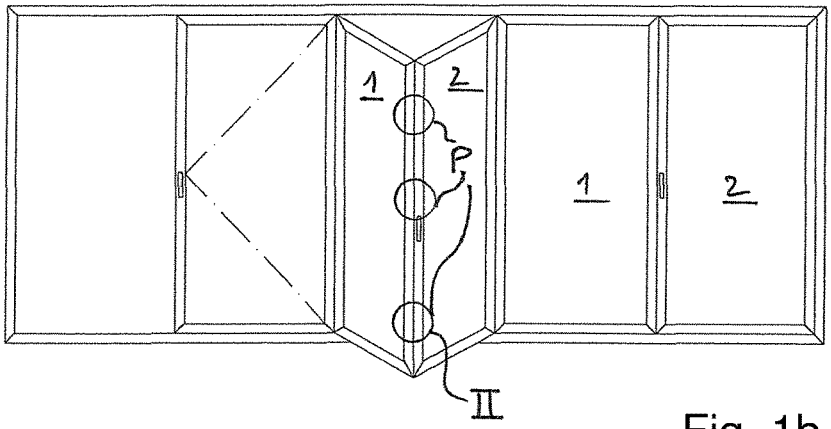

FIG. 1*b* shows the folding device partially open but with closed left rotary panel. In this position, the hinge arrangements can be opened in order to fold the central folding panels 1, 2 into the position illustrated in FIG. 1*c* so that their exterior side is accessible, for example, for cleaning purposes.

Figure 1C:
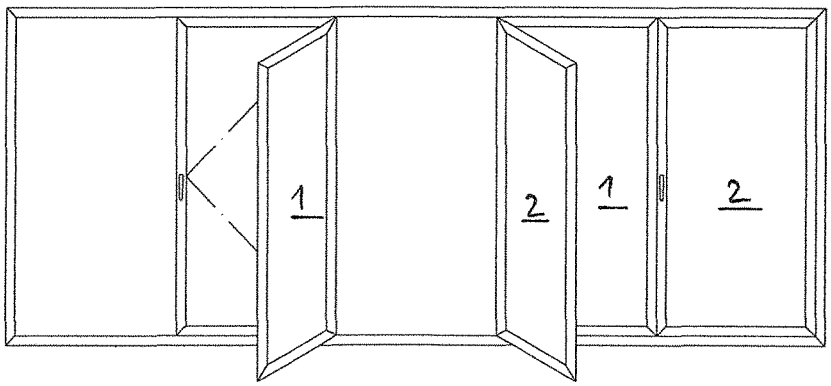
Figure 2A:
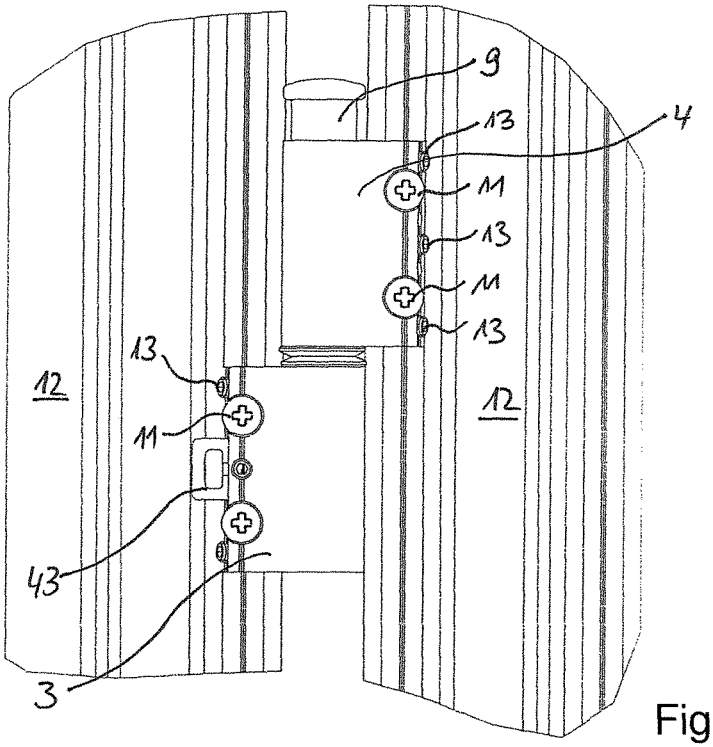
FIGS. 2*a* and 2*b* show in detail a hinge arrangement according to the invention located at the position II in FIG. 1*b* in a basic position in elevation view (FIG. 2*a*) and partially sectioned view (FIG. 2*b*).
Figure 2B:
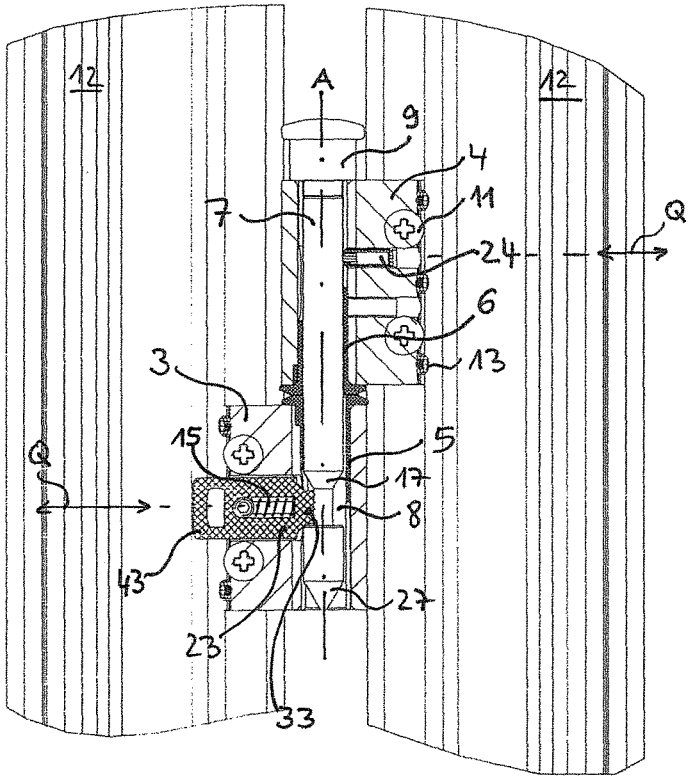

In FIG. 2, for the partially folded position of the folding panels 1, 2 corresponding to FIG. 1*b*, the details of the hinge arrangement not illustrated in FIGS. 1*a*-1*c* can be seen. The hinge arrangement comprises in this context two hinge parts 3, 4 that comprise bushings 5, 6 through which an axial pin (hinge pin) 7 is extending in the basic position shown in FIGS. 2*a*-2*b*. The axial pin 7 has in the lower region a recess 8 and in the upper region a collar 9 which has a diameter that is greater than the diameter of the remaining pin body of the axial pin 7 so that the axial pin 7 cannot slide completely into the bushings 5, 6. The hinge parts 3, 4 are fastened with fastening screws 11 on the frame sections 12 of the folding panels 1, 2. Clamping screws 13 serve for precise positional adjustment.

A fixation element 23 is provided in the hinge part 3 shown at the bottom in the illustration and is slidable in the direction of arrow Q transverse to the longitudinal extension A of the axial pin 7. In the position in FIGS. 2*a*-2*b*, a projection 33 of the fixation element 23 is located in the recess 8 of the axial pin 7 into which it is forced by a spring 15. The axial pin 7 is thus secured safely in the illustrated position. At the end of the fixation element 23 opposite the projection 33, the fixation element 23 is provided with an actuation handle 43. The latter projects in such a way past the remaining regions of the hinge part 3 that, in the partially open position of the folding panels 1, 2 as shown in FIG. 1*b*, it can be manually actuated or actuated by means of an auxiliary tool. In order to simplify this, an extension or enlargement, not illustrated, can be provided at the actuation handle 43, for example, a band or a zipper.

The upper hinge part 4 in the illustration comprises a locking element 24 which is slidable in the direction Q and is in the form of a locking bolt 24 in this embodiment. The locking element 24 is also supported by a spring-loading action but in FIGS. 2 and 3 is forced outwardly by the shaft of the axial pin 7 against the spring force so that it projects only minimally into the bushing 6.

Figure 3A:
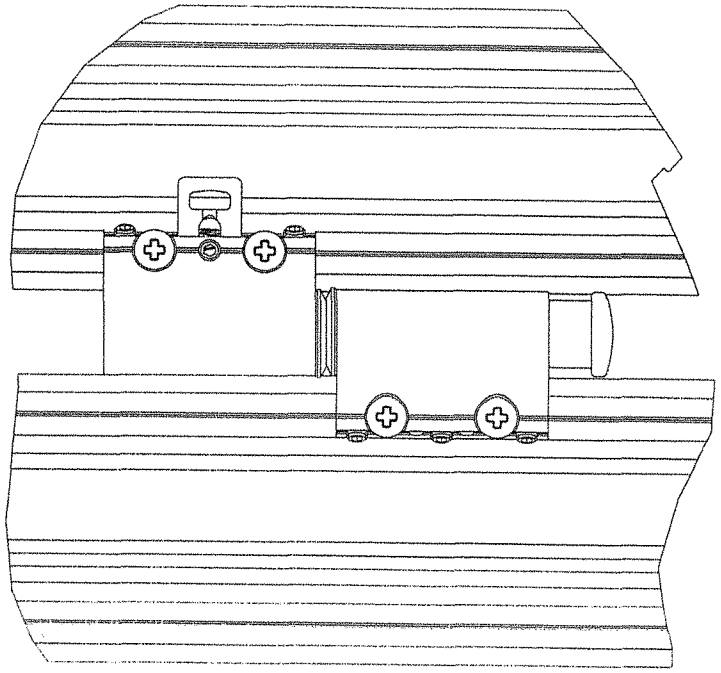
FIGS. 3*a* and 3*b* show in illustrations corresponding to FIGS. 2*a* and 2*b* the fixation element in unlocked position.
Figure 3B:
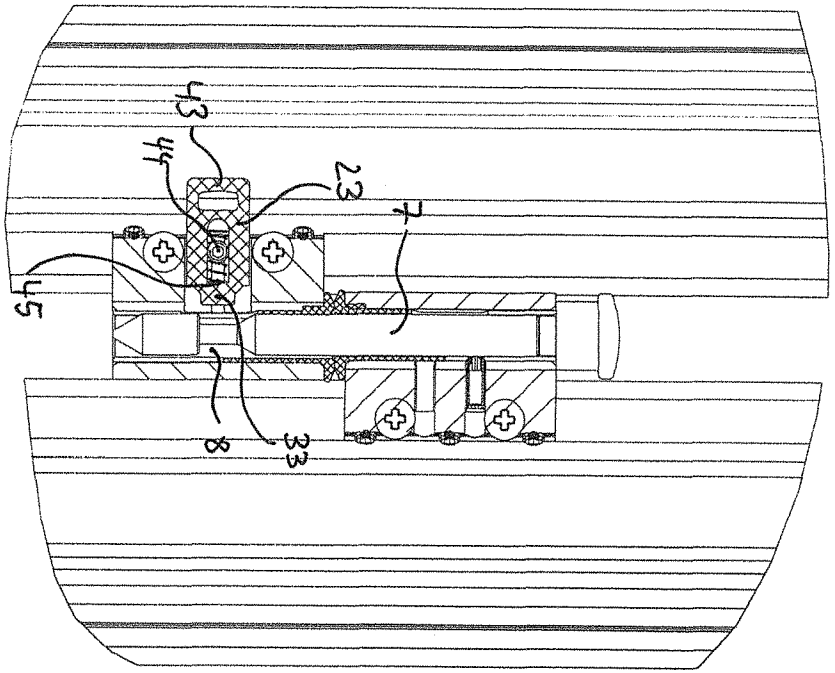

For releasing the hinge parts 3, 4 and thus the folding panels 1, 2 from each other, as illustrated in FIGS. 3*a*-3*b*, the fixation element 23 must be pulled by means of the actuation handle 43 (here a tab or a grip element) against the force of the spring 15 in outward direction so that the projection 33 no longer engages the recess 8 of the axial pin 7. In order for the fixation element 23 not to be accidentally completely pulled out of its guide, a fastening device 44 as well as an abutment 45 for the spring 15 together form a stop.

Figure 4A:
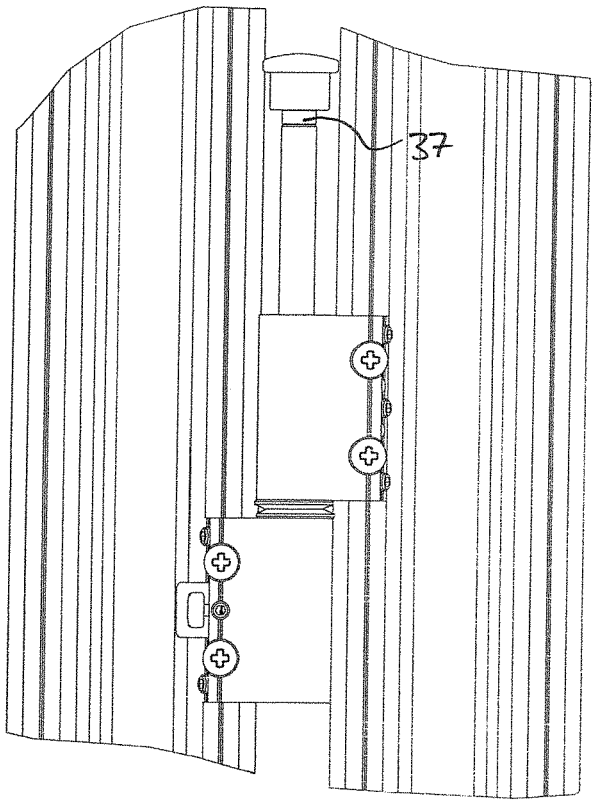
FIGS. 4*a* and 4*b* show in illustrations corresponding to FIGS. 2*a* and 2*b* the hinge arrangement with pulled-out axial pin.
Figure 4B:
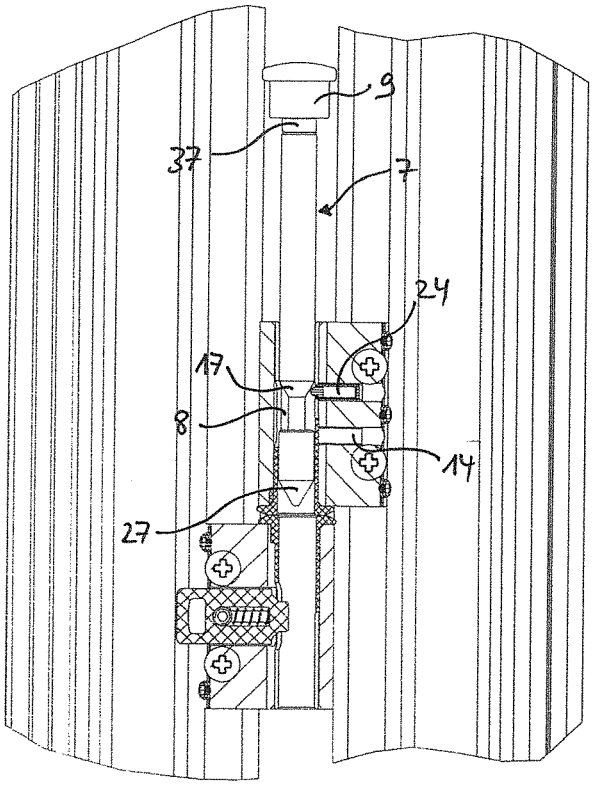

FIGS. 4*a*-4*b* show a position in which the axial pin 7 has been pulled out upwardly from the lower bushing 5. The actuation handle 43 has been subsequently released again so that the spring 15 pushes the fixation element 23 into its original position in which however, without the axial pin 7, it is without any effect. The axial pin 7 is captively secured in the upper bushing 6 because the locking bolt 24 has been pushed from its supporting hinge part 4 by the spring force into the bushing 5 so that the leading end of the locking bolt 24 is now located in the recess 8 of the axial pin 7. The hinge arrangement therefore can be mounted also in inverted arrangement without the axial pin 7 in the illustrated position falling out of the bushing 6 because it is secured by the locking bolt 24. As can be seen, the hinge part 4 has a further recess 14 that is not provided with a locking bolt; in a mirror-inverted arrangement of the hinge, the further recess can receive the locking element also.

Figure 5A:
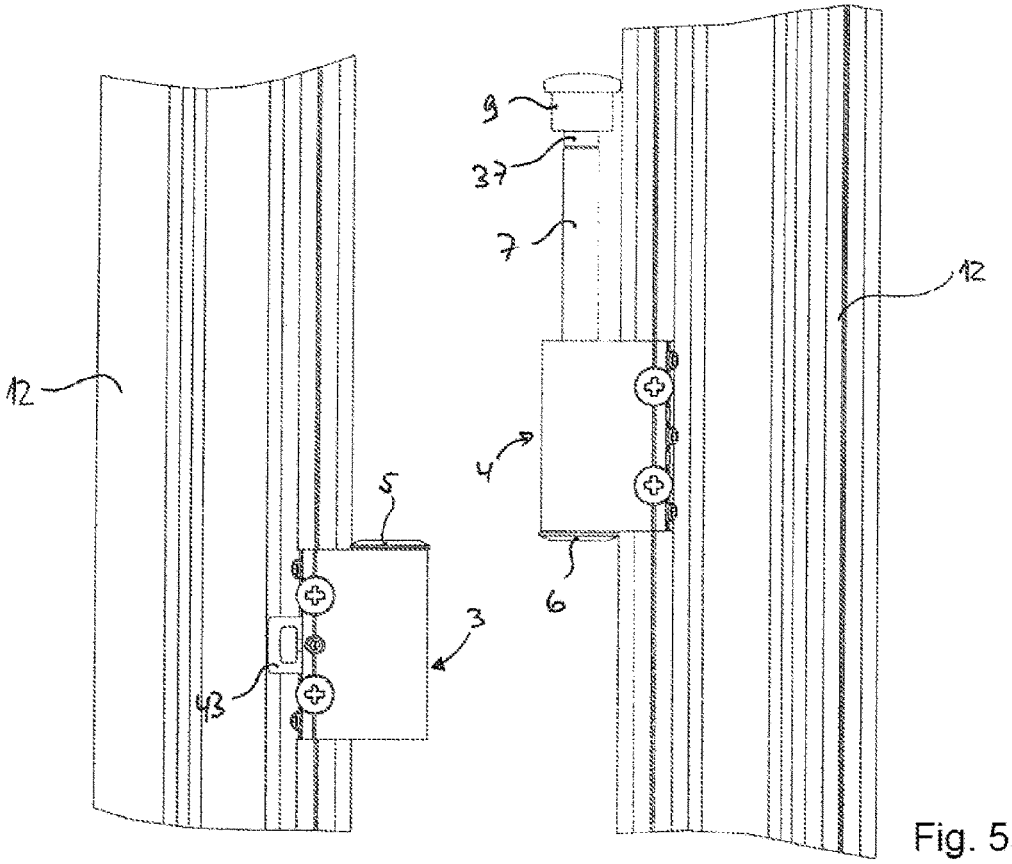
FIGS. 5*a* and 5*b* show in illustrations corresponding to FIGS. 2*a* and 2*b* the folding panels separated from each other as shown in FIG. 1*c*.
Figure 5B:
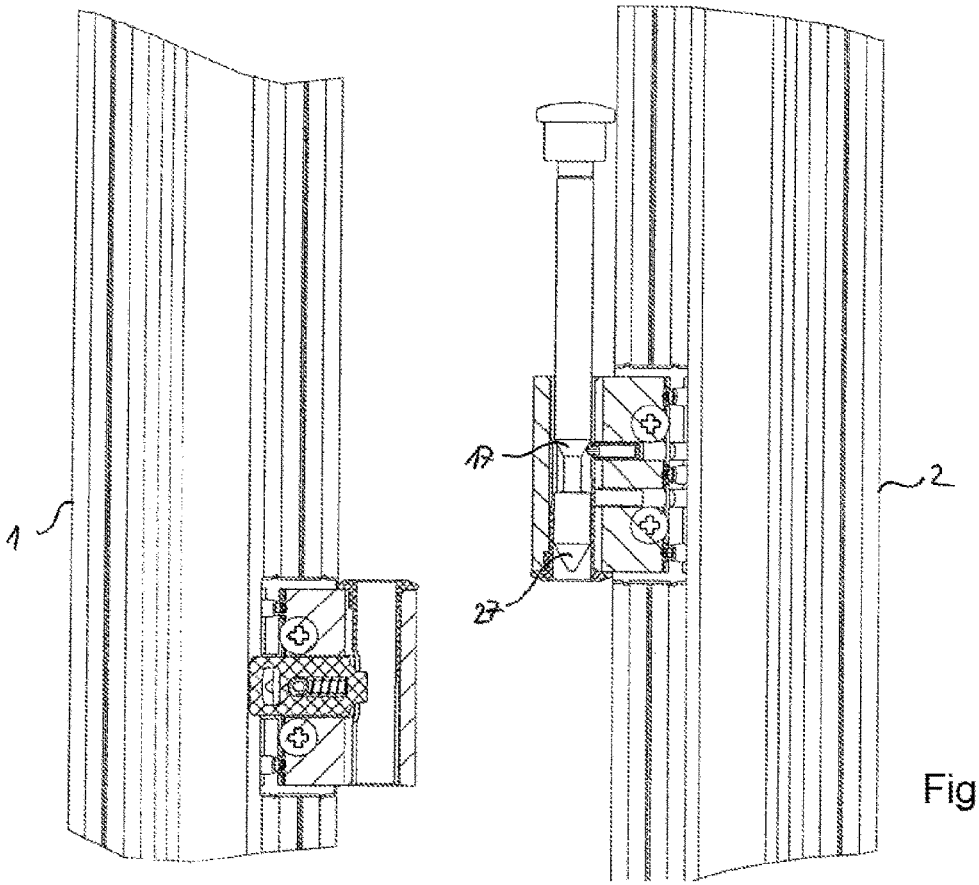

As illustrated in FIGS. 5*a* and 5*b*, in the position with pulled-out axial pin 7 (FIGS. 4 and 5) the folding panels 1, 2 can be separated from each other and can be transferred into the position according to FIG. 1*c*.

In order to reconnect the panels 1, 2, the panels 1, 2 are again turned toward each other until the respective hinge parts 3, 4 with their bushings 5, 6 are congruently aligned on top of each other. Now the axial pins 7 of the hinge arrangements can be pushed in again. A one-sided insertion ramp or elongate bevel at the recess 8 of the axial pin 7 facilitates in this context the action of pushing back the locking bolts 24 while the other side of the recess 8 is embodied without such a ramp in order to provide an improved captive securing action. Preferably, the other end of the axial pin 7 which is facing away from the collar 9 is also provided with an insertion ramp 27 or bevel or cone in order to push back the projection 33 of the fixation element 23 in case the fixation element 23 is not pulled back actively by the grip element 43.

In the illustrated embodiment, the axial pin 7 is provided immediately below the collar 9 with a marking 37, for example, a warning color. When the marking 37 can still be seen after driving in the axial pin 7 into the bushing 5, 6, this warning color serves as an indicator that the axial pin 7 is incompletely inserted and has not yet reached its end position. Such a safety marking can also be provided at the fixation element 23 and would then indicate that the projection 33 is not properly positioned in the recess 8 of the axial pin 7.

Figure 6:
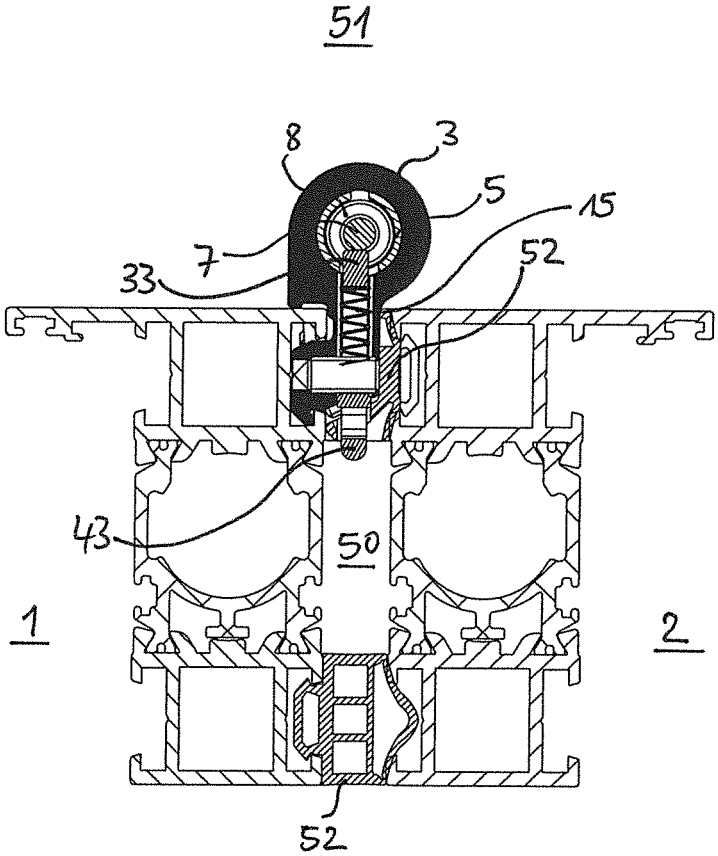
FIG. 6 is a section view along section line VI-VI of FIG. 1*a*.

FIG. 6 shows a section view in the direction VI-VI through the hinge arrangement at the position indicated in FIG. 1*a*. The lower hinge part 3 and the fixation element 23 are shown in section view. It can be taken from this illustration that for completely closed folding device the actuation handle 43 for the fixation element 23 is within an intermediate space 50 between the folding panels 1, 2 or between their lateral frame parts 12 and therefore is not accessible from the exterior side 51 of the device. The intermediate space 50 is furthermore sealed and closed off by seals 52.

The individual elements of the hinge arrangement are substantially configured to be multi-functional so that the hinge arrangement requires only a minimal number of components. For example, the bushing 5 is embodied identical to the bushing 6 and provided with openings for the fixation element 23 as well as for the locking bolt 24. The storage costs are therefore reduced.

The specification incorporates by reference the entire disclosure of German priority document 10 2017 100 644.3 having a filing date of Jan. 13, 2017.

While specific embodiments of the invention have been shown and described in detail to illustrate the inventive principles, it will be understood that the invention may be embodied otherwise without departing from such principles.

What is claimed is:

1. A folding device comprising:

a hinge arrangement comprising an axial pin comprising a pin body having a first end with a collar wider in a radial direction of the axial pin than the pin body;

a first folding panel and a second folding panel that are pivotably and detachably connected to each other by the hinge arrangement;

wherein the hinge arrangement further comprises a first hinge part connected to the first folding panel and further comprises a first bushing;

wherein the hinge arrangement further comprises a second hinge part connected to the second folding panel and further comprises a second bushing;

wherein the first and second hinge parts are connected pivotably to each other by the axial pin extending through the first and second bushings;

wherein the axial pin comprises a recess;

wherein the first hinge part comprises a fixation element extending into the first bushing and slidable in a direction transverse to a longitudinal extension of the axial pin;

wherein the fixation element comprises a projection projecting in a connected state of the first and second folding panels into the recess of the axial pin;

wherein the fixation element, at an end facing away from the axial pin, has an actuation handle, the actuation handle projecting past the first hinge part and arranged such that, when the folding device is closed, the actuation handle is located in an intermediate space between the first and second folding panels connected to each other;

wherein the second hinge part comprises a locking element which is movable into the second bushing in the direction transverse to the longitudinal extension of the axial pin.

2. The folding device according to claim 1, wherein the fixation element is spring-loaded in a direction toward the axial pin.

3. The folding device according to claim 1, wherein the locking element is spring-loaded in a direction toward the axial pin.

4. The folding device according to claim 1, wherein the locking element is arranged relative to the recess of the axial pin such that the axial pin is completely removed from the first bushing of the first hinge part when the locking element of the locking pin is locked in the recess of the axial pin.

5. The folding device according to claim 1, wherein the axial pin has a marking that is recognizable when the connected state of the first and second folding panels is not completely reached and is not recognizable when the connected state of the first and second folding panels is completely reached.

6. The folding device according to claim 1, wherein the fixation element has a marking that is recognizable when the connected state of the first and second folding panels is not completely reached and is not recognizable when the connected state of the first and second folding panels is completely reached.

7. The folding device according to claim 1, wherein the axial pin and the fixation element each have a marking that is recognizable when the connected state of the first and second folding panels is not completely reached and is not recognizable when the connected state of the first and second folding panels is completely reached.

8. The folding device according to claim 1, wherein the fixation element comprises a stop which limits a movement of the fixation element in a direction away from the axial pin.

9. The folding device according to claim 1, wherein the recess of the axial pin comprises an insertion ramp extending in a direction toward the collar.

* * * * *